US010294754B2

(12) United States Patent
Koch et al.

(10) Patent No.: US 10,294,754 B2
(45) Date of Patent: May 21, 2019

(54) RE-CLOSABLE COIL ACTIVATED FRACK SLEEVE

(71) Applicant: BAKER HUGHES, A GE COMPANY, LLC, Houston, TX (US)

(72) Inventors: Jeffrey B. Koch, Calgary (CA); David A. Luft, Calgary (CA); Edward A. Rapin, Cochrane (CA)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 183 days.

(21) Appl. No.: 15/461,115

(22) Filed: Mar. 16, 2017

(65) Prior Publication Data

US 2018/0266212 A1 Sep. 20, 2018

(51) Int. Cl.

| | |
|---|---|
| ***E21B 34/14*** | (2006.01) |
| ***E21B 34/12*** | (2006.01) |
| ***E21B 34/00*** | (2006.01) |

(52) U.S. Cl.

CPC ..... *E21B 34/14* (2013.01); *E21B 34/12* (2013.01); *E21B 2034/007* (2013.01)

(58) Field of Classification Search

CPC .... E21B 34/14; E21B 34/12; E21B 2034/007; E21B 34/00; E21B 34/06; E21B 43/25; E21B 43/26; E21B 43/27

See application file for complete search history.

(56) References Cited

U.S. PATENT DOCUMENTS

| | | | |
|---|---|---|---|
| 4,312,406 | A | 1/1982 | McLaurin et al. |
| 5,263,683 | A | 11/1993 | Wong |
| 5,957,207 | A | 9/1999 | Schnatzmeyer |
| 6,808,020 | B2 | 10/2004 | Garcia et al. |
| 6,907,936 | B2 | 6/2005 | Fehr et al. |
| 7,243,723 | B2 | 7/2007 | Surjaatmadja et al. |
| 7,387,165 | B2 | 6/2008 | Lopez et al. |
| 7,478,676 | B2 | 1/2009 | East et al. |
| 7,487,165 | B2 | 2/2009 | Sauermann et al. |
| 7,575,062 | B2 | 8/2009 | East et al. |
| 7,591,312 | B2 | 9/2009 | Johnson et al. |
| 7,681,654 | B1 | 3/2010 | Cugnet |

(Continued)

FOREIGN PATENT DOCUMENTS

| | | |
|---|---|---|
| CA | 2808635 A1 | 3/2012 |
| WO | 03083256 A1 | 10/2003 |

(Continued)

OTHER PUBLICATIONS

Coon, Robert and Murray, Doug, "Single-Trip Completion Concept Replaces Multiple Packers and Sliding Sleeves in Selective Multi-Zone Production and Stimulation Operations," SPE-29539, pp. 911-915 (Apr. 1995).

*Primary Examiner* — Wei Wang
(74) *Attorney, Agent, or Firm* — Shawn Hunter

(57) ABSTRACT

A bottom hole assembly for performing a borehole treatment has a plurality of ported valve housings where the housings have an assembly of shifting sleeves. The first sleeve is shifted uphole to open the port in the housing and lock the first sleeve in the ports open position. A second sleeve in the same housing is shifted in the same direction as the first sleeve to close the ports in the housing. The second sleeve has profiles for shifting it up to close the housing ports and back down to reopen the housing ports after closing them.

14 Claims, 6 Drawing Sheets

(56) References Cited

U.S. PATENT DOCUMENTS

| | | | |
|---|---|---|---|
| 7,735,559 | B2 | 6/2010 | Malone |
| 8,127,847 | B2 | 3/2012 | Richard et al. |
| 8,490,702 | B2 | 7/2013 | Stromquist et al. |
| 8,695,716 | B2 | 4/2014 | Ravensbergen |
| 8,794,331 | B2 | 8/2014 | Getzlaf et al. |
| 8,857,516 | B2 | 10/2014 | Ganguly et al. |
| 8,960,295 | B2 | 2/2015 | Arizmendi, Jr. et al. |
| 9,010,447 | B2 | 4/2015 | Themig et al. |
| 9,016,376 | B2 | 4/2015 | Surjaatmadja et al. |
| 9,051,813 | B2 | 6/2015 | Howard et al. |
| 9,097,079 | B2 | 8/2015 | Themig |
| 9,194,217 | B2 | 11/2015 | Watson et al. |
| 9,222,335 | B2 | 12/2015 | Caminari et al. |
| 9,234,412 | B2 | 1/2016 | Getzlaf et al. |
| 9,303,501 | B2 | 4/2016 | Fehr et al. |
| 2009/0139717 | A1 | 6/2009 | Richard et al. |
| 2009/0139728 | A1 | 6/2009 | Schrader et al. |
| 2012/0247767 | A1 | 10/2012 | Themig et al. |
| 2013/0014953 | A1 | 1/2013 | Van Petegem |
| 2013/0175040 | A1 | 7/2013 | Madero et al. |
| 2013/0199790 | A1 | 8/2013 | Themig et al. |
| 2013/0248192 | A1 | 9/2013 | Cook |
| 2014/0174746 | A1 | 6/2014 | George et al. |
| 2014/0305648 | A1 | 10/2014 | Getzlaf et al. |
| 2014/0345876 | A1* | 11/2014 | Coon ..... E21B 34/14 166/373 |
| 2015/0083440 | A1 | 3/2015 | Andersen |
| 2015/0129197 | A1 | 5/2015 | Andreychuk et al. |
| 2015/0198007 | A1 | 7/2015 | Stewart et al. |
| 2015/0204164 | A1 | 7/2015 | Themig et al. |
| 2015/0285025 | A1 | 10/2015 | Hughes et al. |
| 2016/0003003 | A1 | 1/2016 | Getzlaf et al. |
| 2016/0010429 | A1 | 1/2016 | Getzlaf et al. |

FOREIGN PATENT DOCUMENTS

| | | | |
|---|---|---|---|
| WO | 2010148494 | A1 | 12/2010 |
| WO | 2012162792 | A1 | 12/2012 |
| WO | 2015012854 | A1 | 1/2015 |
| WO | 2015016858 | A1 | 2/2015 |
| WO | 2015016859 | A1 | 2/2015 |
| WO | 2016073542 | A1 | 5/2016 |

* cited by examiner

RE-CLOSABLE COIL ACTIVATED FRACK SLEEVE

FIELD OF THE INVENTION

The field of the invention relates to sequentially operated sliding sleeve valves to selectively open and then close a port in a treatment valve and more particularly where one sleeve is pulled up to open the port and a second sleeve is also pulled up to close port.

BACKGROUND OF THE INVENTION

In the past frack or other treatment valves operated with a single sleeve that had to be moved in opposed directions to open and close the ports. In some deviated boreholes enough force to shift a sleeve in the downhole direction with set down weight is not available. Sliding sleeve valves were used in pairs or did not have the capacity to be reopened after closing or had other limitations making them unsuitable for treatment is certain applications. The following references are illustrative of some known designs of sliding sleeve valves for borehole treatment operations: U.S. Pat. Nos. 7,591,312; 8,127,847 and US 2009/0139717.

The present invention addresses the issues of the prior designs of sliding sleeve valves for treatment applications in a borehole by providing a tandem sleeve design where the sleeves are pulled uphole. The first sleeve movement opens housing ports and movement of a second sleeve in the same direction moves the second sleeve to where the first sleeve started for the closed position of the ports in the valve housing. The closing sleeve can also be functioned back down in the event the ports in the valve housing need to be reopened. The opening sleeve can be locked in the open position after it is shifted. Known spears using selectively supported collets can be used to shift the opening sleeve and a linkage type shifting tool such as an HB-3 shifting tool from Baker Hughes Incorporated can be used to shift the closing sleeve to close the housing ports. Two HB-3 shifters oriented in mirror image can be used to move the closing sleeve up for closing the housing ports with one shifter and to move the closing sleeve back down to reopen the housing ports.

Those skilled in the art will have a better understanding of the present invention from a review of the description of the preferred embodiment and the associated drawings while recognizing that the full scope of the invention is to be determined from the appended claims.

SUMMARY OF THE INVENTION

A bottom hole assembly for performing a borehole treatment has a plurality of ported valve housings where the housings have an assembly of shifting sleeves. The first sleeve is shifted uphole to open the port in the housing and lock the first sleeve in the ports open position. A second sleeve in the same housing is shifted in the same direction as the first sleeve to close the ports in the housing. The second sleeve has profiles for shifting it up to close the housing ports and back down to reopen the housing ports after closing them.

DETAILED DESCRIPTION OF THE PREFERRED EMBODIMENT

Figure 1:
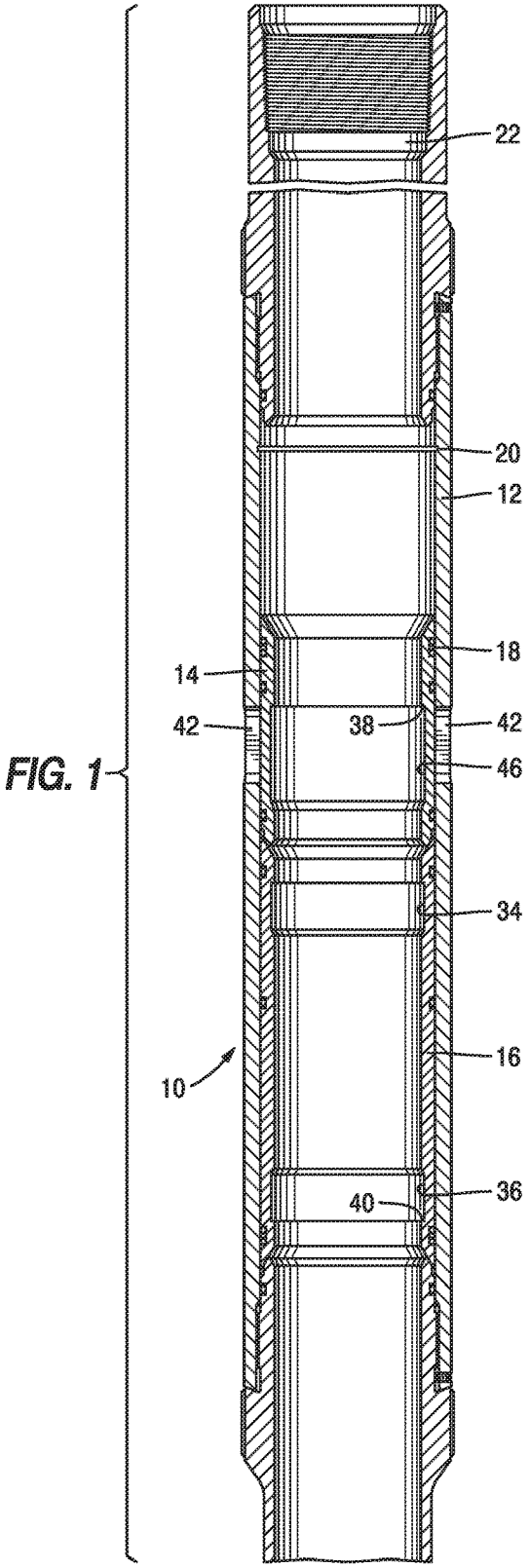
FIG. 1 is a section view of a valve housing with dual sleeves with the ports closed.

FIG. 1 shows a valve assembly 10 that is one of an array in a bottom hole assembly for treating a zone. A housing 12 has an upper sleeve 14 and a lower sleeve 16. A snap ring 18 expands into a groove 20 in housing 12 to retain the upper sleeve 14 after it is shifted in an uphole direction by an inner assembly preferably run into passage 22 on coiled tubing. The inner assembly preferably has a resettable packer that is not shown that is located between spaced shifting tools 24 and 26. The shifting tool 24 is a known design made available by Baker Hughes Incorporated and known as an HB-3. It is linkage operated and the links 28 and 30 that relatively pivot to bring out a profile 32 that can be configured to grab a recess such as 34 or 36 to shift a second sleeve 16 in one of opposed directions. Recess 34 has a right angle at uphole end 38 while recess 36 has the right angle in mirror image on the downhole end 40. Sleeve 16 is moved by tool 24 in the uphole direction to close ports 42 by engagement into recess 34. Recess 36 is engaged by an oppositely oriented linkage in recess 36 to move sleeve 16 away from ports 42 to reopen them. A single tool 24 can have oppositely oriented linkages 28 and 30 or 30 and 28 so that a single tool body can shift sleeve 16 in opposed directions. Alternatively two tools 24 can be provided in opposite orientation and one will grab recess 34 to close ports 42 while the other will grab recess 36 to reopen ports 42.

Figure 2:
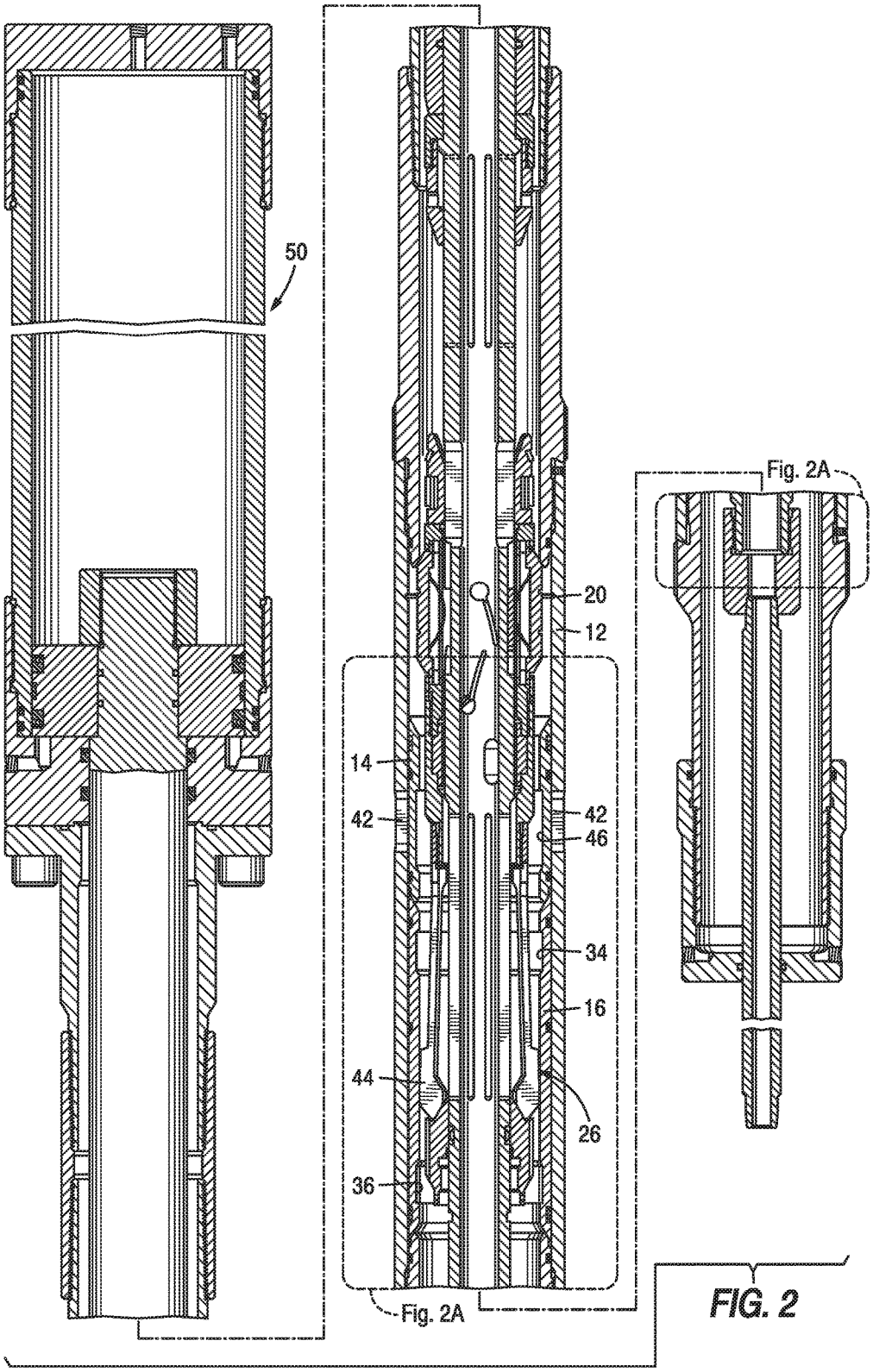
FIG. 2 is a section view of an inner assembly collet type shifting tool located below an upper sleeve before the upper sleeve is shifted.
Figure 2A:
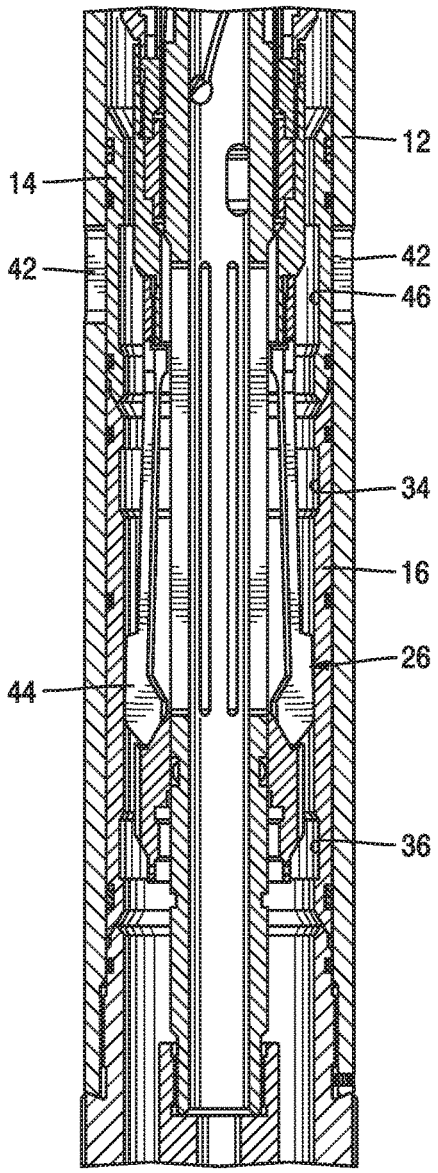
Figure 4:
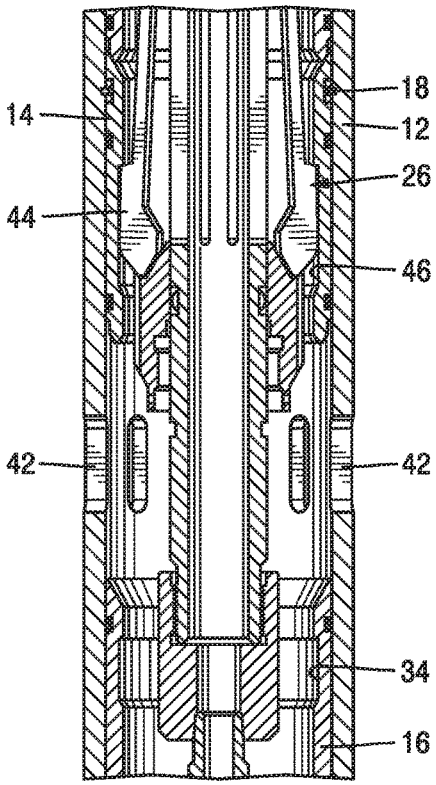
FIG. 4 is an enlarged view of FIG. 3.
Figure 3:
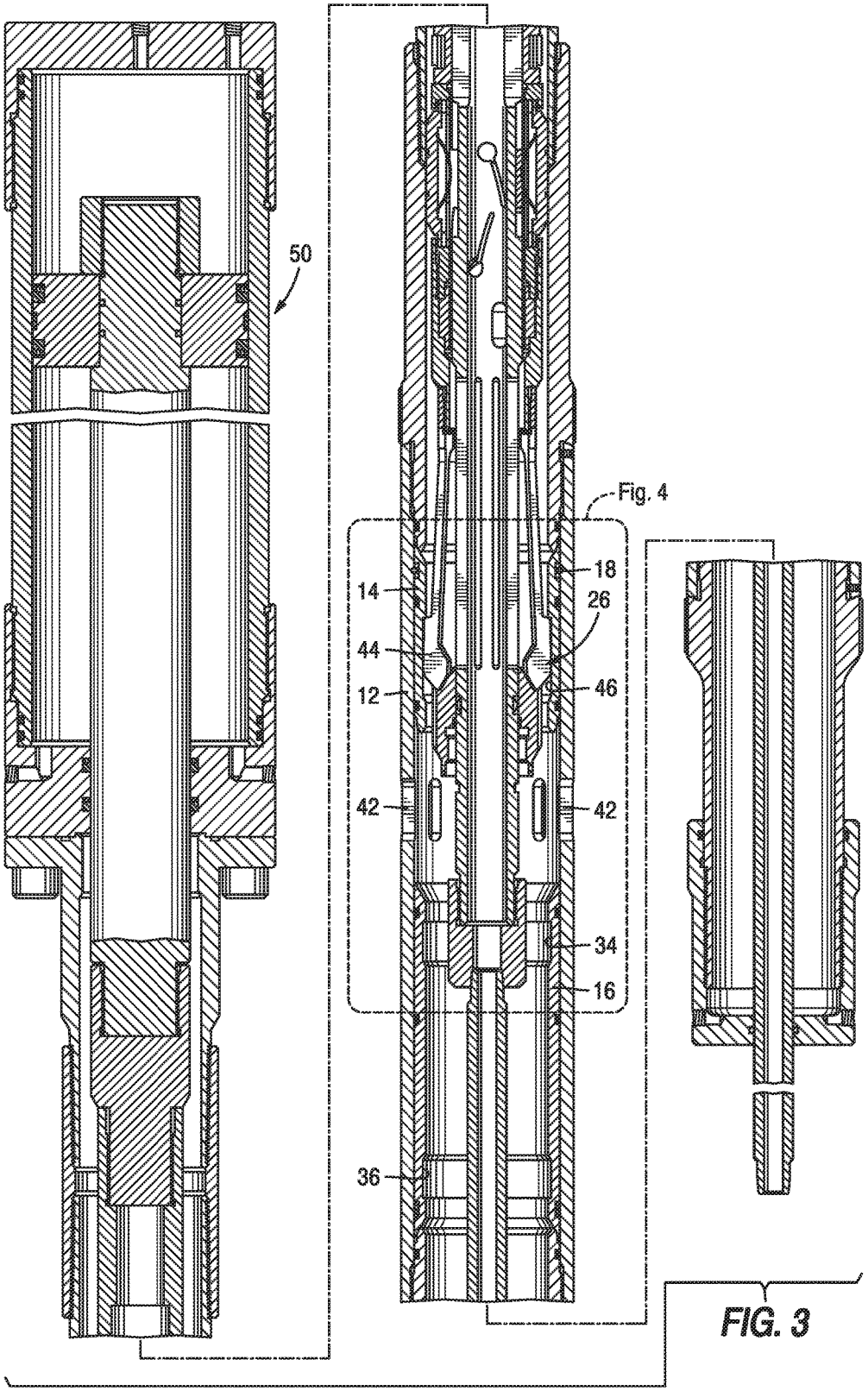
FIG. 3 is the view of FIG. 2 with the upper sleeve groove engaged for shifting up to open the housing ports.
Figure 5:
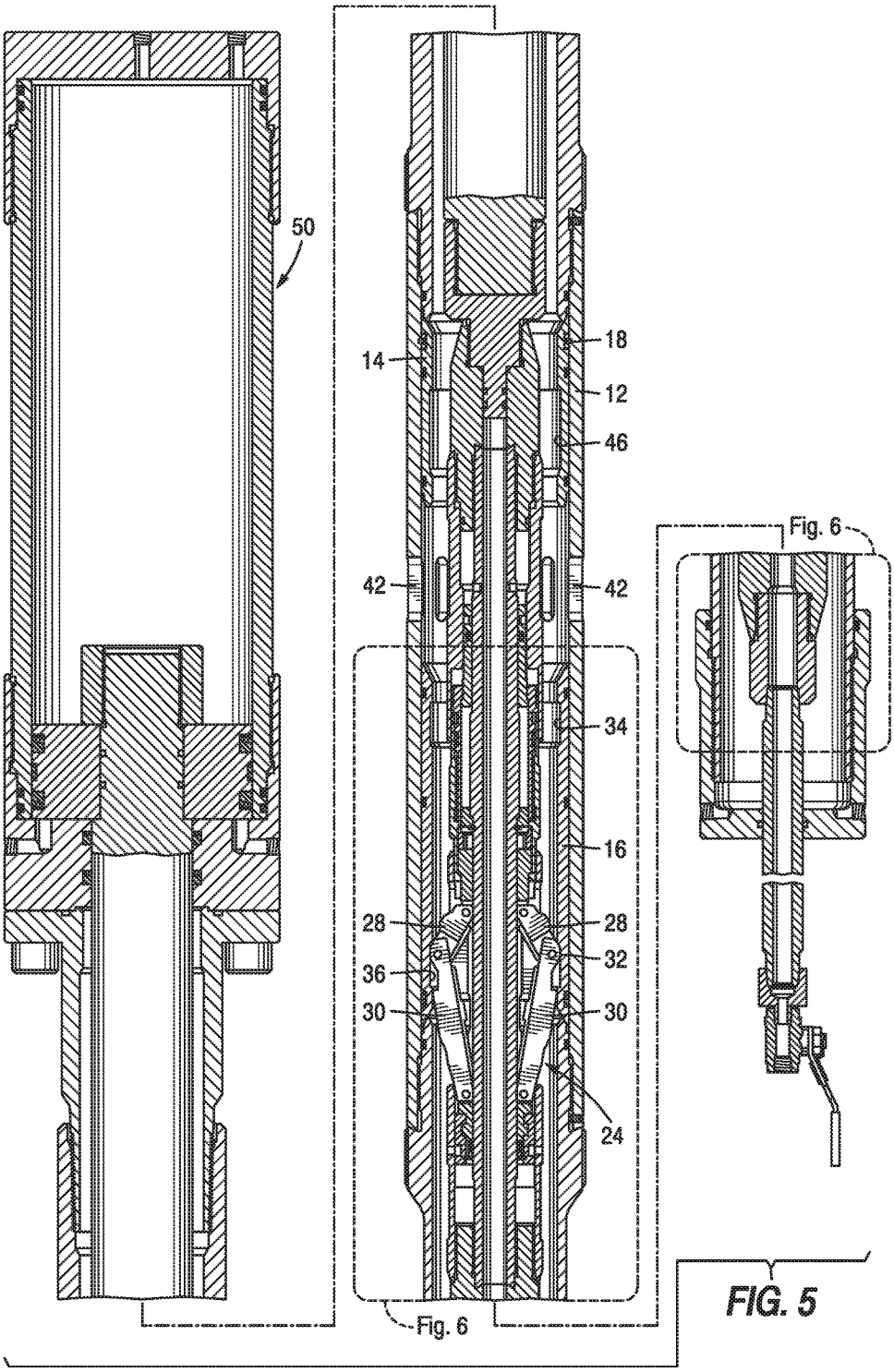
FIG. 5 shows a linkage type shift tool of the inner assembly at the lower groove of the second sleeve.
Figure 6:
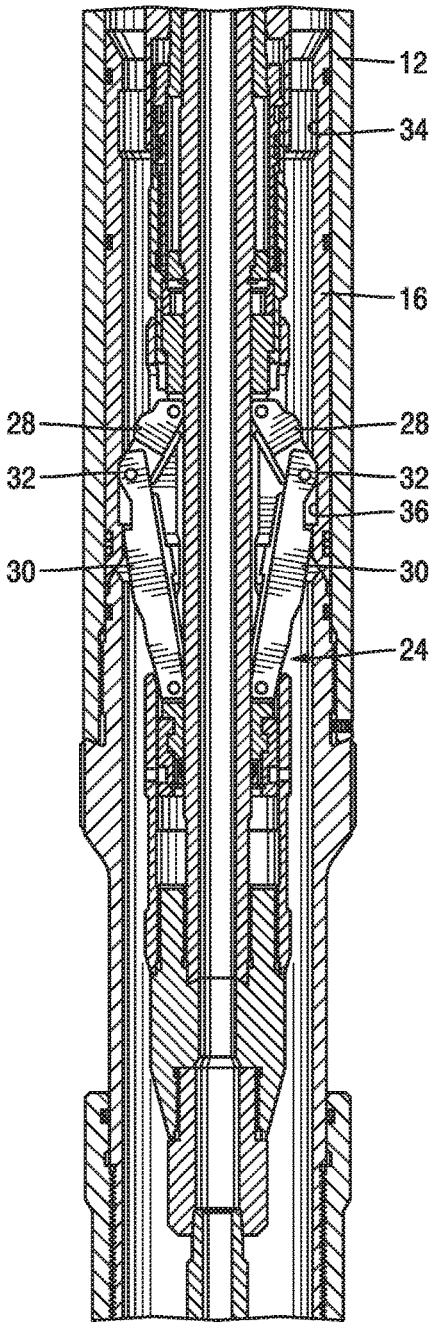
FIG. 6 is an enlarged view of FIG. 5.
Figure 7:
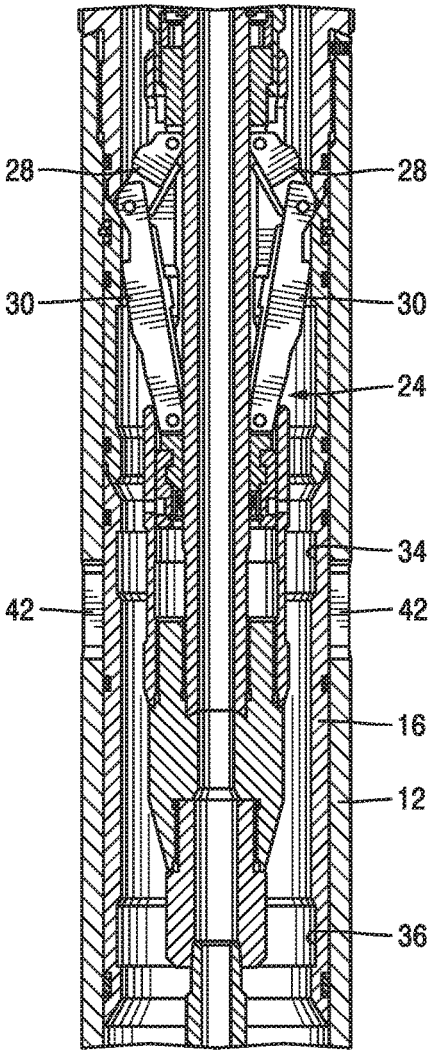
FIG. 7 is the view after the upper groove of the lower sleeve is engaged, shifted and released to show the linkage type shifting tool past the shift groove in the upper sleeve and ready to move into another valve housing.

Sleeve 14 is shifted by a known design of a collet type shifter that can support or unsupport collet heads 44 using a j-slot and string manipulation. FIG. 2 shows the collet heads 44 below the target recess 46 on the way to get locked into recess 46 for an upward pull on sleeve 14 to open housing ports 42. The sleeve 14 is locked with snap ring 18 going into groove 20 at the conclusion of shifting. Resistance will be felt at the surface to indicate sleeve 14 has fully shifted and the ports 42 are open. At that time the string is manipulated to unsupport the collet heads 44 as well as the resettable packer in the work string that is not shown so that a different valve housing can be used to continue treatment of a zone. It should be noted that the sequence of movements is to slide open sleeve 14 and then perform a treatment through openings 42 with the resettable packer set to hold pressure. After the treatment ends the resettable packer is released and the inner string is moved so that tool 24 can engage recess 34 and pull up sleeve 16 to close ports 42. The inner string then moves to the next valve assembly 10 and the treatment continues. After treatment through all the desired valves 10 the inner string can be used to shift down sleeve 16 with tool 24 engages in recess 40 so that production, for example, can commence.

Those skilled in the art will appreciate that the use of separate sleeves that shift up allows a piston cylinder assembly such as 50 in a test fixture to apply the necessary force in an uphole direction to move a sleeve. Pulling tension on the coiled tubing is employed to move shifting sleeve 14 with a shifting tool to open ports 42 and sleeve 16 to close the same ports. For reopening any ports 42 weight is set down to move sleeve 16 in a downhole direction. Sleeve 14 stays locked after being initially shifted uphole.

It is preferred to employ an inner string that has the capability in a single trip to shift sleeve 14 up and sleeve 16 up and then down. Sometimes there may be a delay from when all the ports 42 are closed after treatment and when production begins and in that case the inner string is removed with the coiled tubing. Although coiled tubing is preferred, rigid tubing is also envisioned. Other types of known shifting tools can be used to get the requisite movements of the sleeves 14 and 16 in the uphole direction for sequential treatment of a zone with uphole movement of the opening sleeve 14 and the closing sleeve 16. Treatment flow can be through the coiled tubing backstopped by a set resettable packer.

The above description is illustrative of the preferred embodiment and many modifications may be made by those skilled in the art without departing from the invention whose scope is to be determined from the literal and equivalent scope of the claims below:

We claim:

1. A treatment method for a zone in a borehole, comprising:

operating at least one port in at least one valve housing, said housing part of a bottom hole assembly comprising multiple spaced said housings in said zone, between open and closed positions;

moving a first sleeve to open said at least one port;

moving a second sleeve in the same direction as said first sleeve to close said at least one port; and moving said first and second sleeves in an uphole direction to first open and then close the at least one port.

2. The method of claim 1, comprising:

moving said second sleeve into a position formerly occupied by said first sleeve to close said at least one port.

3. The method of claim 1, comprising:

locking said first sleeve in a shifted position with said at least one port open.

4. The method of claim 3, comprising:

releasing a snap ring into a groove in said valve housing for said locking.

5. The method of claim 1, comprising:

moving said second sleeve in a downhole direction to reopen said at least one port after moving said second sleeve in an uphole direction to close said at least one port.

6. The method of claim 1, comprising:

manipulating a shifting assembly in said valve housing on coiled tubing for moving said sleeves.

7. The method of claim 1, comprising:

providing different shifting tools for moving said first and second sleeves on a common shifting assembly.

8. The method of claim 7, comprising:

shifting said first sleeve with a first shifting tool that selectively supports at least one collet in a first recess in said first sleeve.

9. The method of claim 8, comprising:

shifting said second sleeve with a second shifting tool that uses a plurality of pivoting linkages engaging a second recess located in said second sleeve.

10. The method of claim 9, comprising:

providing spaced mirror image second and third recesses in said second sleeve.

11. The method of claim 10, comprising:

configuring said pivoting linkages on a common body to engage both said second and said third recesses.

12. The method of claim 10, comprising:

configuring said pivoting linkages on different tool bodies to engage both said second and third recesses for opposed movement of said second sleeve.

13. A treatment valve for a zone in a borehole, comprising:

a housing having a passage therethrough and end connections for securing said housing to a tubular string;

said housing further comprising a lateral port selectively opened and closed with discrete sleeves mounted in said housing; and said sleeves moving in an uphole direction to open and then close said at least one lateral port.

14. The valve of claim 13, wherein:

said sleeves comprise a first sleeve whose movement is locked after shifting to open said at least one lateral port and a second sleeve movable in opposed directions.

* * * * *